US006770410B2

(12) United States Patent
Yu et al.

(10) Patent No.: US 6,770,410 B2
(45) Date of Patent: Aug. 3, 2004

(54) IMAGING MEMBER

(75) Inventors: Robert C. U. Yu, Webster, NY (US); Timothy J. Fuller, Pittsford, NY (US); Kathleen M. Carmichael, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/286,706

(22) Filed: Oct. 31, 2002

(65) Prior Publication Data

US 2004/0086796 A1 May 6, 2004

(51) Int. Cl.[7] ..... G03G 5/047

(52) U.S. Cl. ..... 430/59.6; 430/58.15; 430/58.25; 430/58.5; 430/58.8; 430/64

(58) Field of Search ..... 430/59.6, 58.15, 430/58.25, 58.5, 58.8, 64, 58.65, 58.05, 56, 65

(56) References Cited

U.S. PATENT DOCUMENTS

| | | | | |
|---|---|---|---|---|
| 4,233,384 | A | 11/1980 | Turner et al. | 430/59 |
| 4,265,990 | A | 5/1981 | Stolka et al. | 430/59 |
| 4,299,897 | A | 11/1981 | Stolka et al. | 430/59 |
| 4,306,008 | A | 12/1981 | Pai et al. | 430/59 |
| 4,410,616 | A | 10/1983 | Griffiths et al. | 430/59 |
| 4,439,507 | A | 3/1984 | Pan et al. | 430/59 |
| 5,830,614 | A | 11/1998 | Pai et al. | 430/59 |
| 6,020,096 | A | 2/2000 | Fuller et al. | 430/58.35 |
| 6,171,741 | B1 | 1/2001 | Evans et al. | 430/58.35 |
| 6,200,716 | B1 * | 3/2001 | Fuller et al. | 430/64 |
| 6,242,144 | B1 | 6/2001 | Lin et al. | 430/58.4 |
| 6,410,196 | B1 * | 6/2002 | Carmichael et al. | 430/59.6 |
| 6,528,226 | B1 * | 3/2003 | Yu et al. | 430/132 |
| 6,645,686 | B1 * | 11/2003 | Fu et al. | 430/58.4 |

* cited by examiner

*Primary Examiner*—John L. Goodrow
(74) *Attorney, Agent, or Firm*—Oliff & Berridge, PLC; Eugene O. Palazzo

(57) ABSTRACT

An imaging member including, for example, a substrate, a charge blocking layer, an optional adhesive layer, a charge generating layer, a charge transporting layer comprising a charge transport component and a polymer binder substantially free of low molecular weight fractions.

31 Claims, No Drawings

IMAGING MEMBER

BACKGROUND

The present invention is generally directed to imaging members, imaging apparatus, and processes thereof. More specifically, the present invention relates to multilayered electrophotographic imaging members having a novel charge transport layer composition comprising a charge transport compound dissolved in a polymer, and wherein the low molecular weight fraction of the polymers has been selectively removed from the polymer prior to charge transport layer preparation. The present invention also relates to processes for forming images on the member.

Typical imaging members include, for example: (1) photosensitive members or photoreceptors, which are commonly utilized in electrophotographic imaging systems, such as, xerographic machines, and (2) electroreceptors, like ionographic imaging members, which are used for electrographic imaging systems. Imaging members are usually available in two forms, the rigid drum configuration and the flexible belt. The flexible imaging member belts may either be seamless or seamed belts. Typical electrophotographic imaging member belts comprise an imaging layer of a charge transport layer and a charge generating layer coated over one side of a flexible supporting substrate and an anti-curl back coating applied to the opposite side of the substrate to provide imaging member flatness. Electrographic imaging member belts are somewhat simpler in structure; they typically comprise a dielectric imaging layer on one side of a flexible supporting substrate and may also have an anti-curl back coating on the opposite side of the substrate. A typical flexible imaging member belt has a ground strip coated near one edge of the belt and adjacent to the imaging layer.

Photosensitive members having at least two electrically operative layers provide electrostatic latent images when charged with a uniform negative electrostatic charge, exposed to a light image and then developed with finely divided electroscopic marking particles. The resulting toner image is usually transferred to a suitable receiving member such as paper.

As more advanced, higher speed electrophotographic imaging copiers, duplicators and printers were developed, in some instances, degradation of image quality was encountered during extended cycling. Moreover, complex, highly sophisticated duplicating and printing systems operating at very high speeds have placed stringent requirements including narrow operating limits on photoreceptors. For electrophotographic imaging members having flexible belt configuration, the numerous layers selected from photoconductive imaging members should be highly flexible, adhere well to adjacent layers, and exhibit predictable electrical characteristics within narrow operating limits to provide excellent toner images over many thousands of cycles. One type of multi-layered photoreceptor that has been employed as a belt in electrophotographic imaging systems comprises a flexible support substrate, a conductive layer, a blocking layer, an adhesive layer, a charge generating layer, a charge transport layer, and a conductive ground strip layer adjacent to one edge of the imaging layers. This photoreceptor belt usually comprises an additional layer such as an anti-curl back coating on the back side of the support substrate in order to provide the desired belt flatness.

Flexible photoreceptor belts are fabricated from sheets cut from an electrophotographic imaging member web stock.

The cut sheets are generally rectangular in shape and all edges may be of the same length or one pair of parallel edges may be longer than the other pair of parallel edges. The sheet is fabricated into a belt by joining the overlapping opposite marginal end regions of the sheet. A seam is typically produced in the overlapping opposite marginal end regions at the point of joining. Joining may be effected in any suitable manner, such as welding including for example ultrasonic processes, gluing, taping, pressure/heat fusing, and the like methods. However, ultrasonic seam welding is generally utilized in embodiments as the method of joining because it is rapid, clean, generally free of solvent application, and produces a thin and narrow strong seam. The fabricated flexible photoreceptor belt mounted around a multi-roller belt support module and selected in an electrophotographic imaging machine may undergo bending and flexing as the belt is dynamically cycled over the plurality of support and drive rollers of the belt support module.

In a machine service environment, a flexible imaging member belt, mounted on a belt supporting module, is generally exposed to repetitive electrophotographic image mechanical cycling which subjects the outer exposed anti-curl back coating to abrasion due to mechanical fatigue and interaction with the belt drives and other support rollers as well as sliding contact with backer bars. This repetitive cycling can lead to a gradual deterioration in the physical/mechanical integrity of the exposed anti-curl backing layer. When the anti-curl back coating is worn the thickness thereof is reduced and the anti-curl back coating experiences a loss of ability to counteract the tendency of imaging members upward curling which leads to the exhibition of belt curl-up at both edges. Moreover, uneven wear of the anti-curl back coating has been found to cause early development of belt ripples which are ultimately manifested as copy printout defects. Thus, the anti-curl back coating wear that results from mechanical contact interaction during dynamic imaging operations is a significant problem that shortens the service life of the belt and adversely affects image quality. Let it be pointed out here that anti-curl back coating wear is an unique problem only to the imaging member belt configuration, since rigid imaging member drums do not require this coating.

Also, numerous other imaging members for electrostatographic imaging systems are known including selenium, selenium alloys, such as arsenic selenium alloys; layered inorganic imaging members, and layered organic members. Examples of layered organic imaging members include those containing a charge transporting layer and a charge generating layer. Thus, for example, an illustrative layered organic imaging member can be comprised of a conductive substrate, overcoated with a charge generator layer, which in turn is overcoated with a charge transport layer. Examples of generator layers that can be employed in these members include, for example, charge generator materials such as; selenium, cadmium sulfide, vanadyl phthalocyanine, x-metal free phthalocyanine, benzimidazole perylent (BZP), hydroxygallium phthalocyanine (HOGaPc), chlorogallium phthalocyanine, and trigonal selenium dispersed in binder resin, while examples of transport layers include dispersions of various diamines, reference, for example, U.S. Pat. No. 4,265,990, the disclosure of which is incorporated herein by reference in its entirety.

A further mechanical problem associated with a photoreceptor belt, comprising a charge generating layer and the charge transport layer, is that the thickness of the outermost charge transport layer tends to become thinner during image cycling as a result of wear. This decrease in thickness may cause changes in the electrical performance of the photoreceptor. Thus, to maintain image quality, complex and sophisticated electronic equipment is of value in the imaging machine to compensate for the electrical changes. This increases the complexity of the machine, cost of the machine, size of the footprint occupied by the machine, and the like. Without proper compensation of the changing electrical properties of the photoreceptor during cycling, the quality of the images formed can degrade due to spreading of the charge pattern on the surface of the imaging member and result in a decline in image resolution. High quality images are of value for digital copiers, duplicators, printers, and facsimile machines, particularly laser exposure machines that demand high resolution images.

There continues to be a need for improved imaging members, and improved imaging systems utilizing such members. Additionally, there continues to be a need for imaging members having reduced transport layer cracking in response to externally imposed tensile stress and with the wear resistant enhanced outermost exposed layers, which members are economical to prepare and retain a number of their properties over extended time periods.

REFERENCES

In U.S. Pat. No. 5,830,614 to Pai et al, issued Nov. 3, 1998, there is disclosed a charge transport dual layer for use in a multilayer photoreceptor comprising a support layer, a charge generating layer, and a charge transport layer comprising a first transport layer comprising a charge transporting polymer, and a second transport layer comprising a charge transporting polymer having a lower weight percent of charge transporting segments than that of the charge transporting-polymer in the first transport layer. Flexible electrophotographic imaging belt members may comprise a photoconductive layer comprising a single layer or composite layers. One type of composite photoconductive layer used in electrophotography is illustrated in U.S. Pat. No. 4,265,990, which describes a photosensitive member having at least two electrically operative layers. One layer comprises a photoconductive layer, which is capable of photogenerating holes and injecting the photogenerated holes into a contiguous charge transport layer. Generally, where the two electrically operative layers are supported on a conductive layer with the photoconductive layer sandwiched between the contiguous charge transport layer and the conductive layer, the outer surface of the charge transport layer is normally charged with a uniform charge of a negative polarity and the supporting electrode is utilized as an anode. The supporting electrode however may still function as an anode when the charge transport layer is sandwiched between the supporting electrode and the photoconductive layer. The charge transport layer in this latter embodiment may be capable of supporting the injection of photogenerated electrons from the photoconductive layer and transporting the electrons through the charge transport layer.

In U.S. Pat. No. 4,410,616 to Griffiths et al., issued Oct. 18, 1983, there is disclosed an improved ambipolar photoresponsive device useful in imaging systems for the production of positive images, from either positive or negative originals, which device is comprised of: (a) supporting substrate, (b) a first photogenerating layer, (c) a charge transport layer, and (d) a second photogenerating layer, wherein the charge transport layer is comprised of a highly insulating organic resin having dissolved therein small molecules of an electrically active material of N,N'-diphenyl-N,N'-bis("X substituted" phenyl)-[1,1,-biphenyl]-4,4'-diamine, wherein X is selected from the group consisting of alkyl and halogen.

U.S. Pat. No. 4,265,990 to Stolka et al, issued May 5, 1981, illustrates a photosensitive member having at least two electrically operative layers is disclosed. The first layer comprises a photoconductive layer which is capable of photogenerating holes and injecting photogenerated holes into a contiguous charge transport layer. The charge transport layer comprises a polycarbonate resin containing from about 25 to about 75 percent by weight of one or more of a compound with the specified general formula illustrated.

U.S. Pat. No. 6,242,144 describes a charge transport layer including an electrically inactive resin binder such as polycarbonate resin, polyester, polyarylate, polyacrylate, polyether, polysulfone, and the like, with weight average molecular weights varying from about 20,000 to about 150,000.

U.S. Pat. No. 6,020,096 illustrates a charge transport layer including any suitable electrically inert film forming polymeric binder such as poly(4,4'-isopropylidene-diphenylene) carbonate, poly(4,4'-isopropylidenediphenylene)carbonate, poly(4,4'-diphenyl-1,1'-cyclohexane carbonate), polyaryl ketones, polyester, polyarylate, polyacrylate, polyether, polysulfone, and the like.

U.S. Pat. No. 6,171,741 describes that a photoreceptor includes a charge transport layer including an electrically inactive resin material, for example, polycarbonate resins having a weight average molecular weight from about 20,000 to about 150,000. In embodiments, polycarbonate resins include poly(4,4'-dipropylidene-diphenylene carbonate) with a weight average molecular weight of from about 35,000 to about 40,000, available as LEXAN 145™ from General Electric Company; poly(4,4'-isopropylidene-diphenylene carbonate) with a weight average molecular weight of from about 40,000 to about 45,000, available as LEXAN 141™ from General Electric Company; a polycarbonate resin having a weight average molecular weight of from about 50,000 to about 120,000, available as MAKROLON™ from Bayer Corporation; or a polycarbonate resin having a weight average molecular weight of from about 20,000 to about 50,000 available as MERLON™ from Mobay Chemical Company. In specific embodiments, methylene chloride is a desirable component of the charge transport layer coating mixture for adequate dissolving of all the components and for its low boiling point.

Examples of electrophotographic imaging members having at least two electrically operative layers, including a charge generator layer and diamine containing transport layer, are disclosed in U.S. Pat. Nos. 4,265,990, 4,233,384, 4,306,008, 4,299,897 and 4,439,507, the disclosures thereof being incorporated herein in their entirety.

The entire disclosures of these patents are incorporated herein by reference.

SUMMARY

Disclosed herein is an electrophotographic imaging member comprising a flexible supporting substrate having an electrically conductive surface, a hole blocking layer, an optional adhesive layer, a charge generating layer, a hole transporting layer comprised of a solid solution comprising an organic hole transport dissolved in a film forming polymer binder and which binder is free of low molecular weight fractions, wherein low represents a weight average molecular weight of from about 1,000 to about 20,000 and a number average molecular weight of from about 1,000 to about 20,000 and an anti-curl back coating.

Also disclosed is an improved positively charged electrophotographic imaging member comprising a film forming polymeric binder component and an organic electron transport compound in the hole transport layer wherein the polymeric component contains no low molecular weight fractions, wherein low represents a weight average molecular weight of from about 1,000 to about 20,000 and a number average molecular weight of from about 1,000 to about 20,000.

Aspects illustrated herein relate to:

a substrate having a conductive surface, an optional electron blocking layer, an optional adhesive layer, a charge generating layer, an electron transporting layer comprising a film forming polymer binder comprising no low molecular weight fractions, and further comprising an organic electron transport compound selected, for example, from the group consisting of a carboxlfluorenone malonitrile (CFM), a nitrated fluoreneone, N,N'bis(dialkyl)-1,4,5,8-naphthalenetetracarboxylic diimide, and N,N'bis(diaryl)-1,4,5,8-naphthalenetetracarboxylic diimide, 1,1'-dioxo-2-(aryl)-6-phenyl-4-(dicyanomethylidene) thiopyran, carboxybenzylnaphthaquinone, and an anti-curl back coating.

Aspects illustrated herein relate to:

a substrate having an electrically conductive surface, an optional charge blocking layer, an optional adhesive layer, an ambipolar layer comprising a polymer binder substantially free of low molecular weight fractions, an organic hole transport compound consisting of an arylamine and an electron transporter selected, for example, from the group consisting of a carboxlfluorenone malonitrile (CFM), a nitrated fluoreneone, N,N'bis(dialkyl)-1,4,5,8-naphthalenetetracarboxylic diimide, N,N'bis(diaryl)-1,4,5,8-naphthalenetetracarboxylic diimide, or 1,1'-dioxo-2-(aryl)-6-phenyl-4-(dicyanomethylidene) thiopyran, carboxybenzylnaphthaquinone, diphenoquinone, and further comprising a dispersion of photoconductive pigments, and an anti-curl back coating.

The members may be imaged by depositing a uniform positive electrostatic charges on the imaging member, exposing the imaging member to activating radiation in an image configuration to form an electrostatic latent image, and developing the latent image with electrostatically attractable marking particles to form a toner image in conformance to the latent image.

A typical negatively charged, multilayered electrophotographic imaging member or photoreceptor of a flexible belt configuration comprises a flexible substrate support, a conductive surface layer, a charge (hole) blocking layer, an optional adhesive layer, a charge generating layer, and a charge (hole) transport layer, and an anti-curl back coating. The thickness of the substrate support depends on numerous factors, including mechanical strength, flexibility, and economical considerations; and thereby, this layer for a flexible belt may, for example, have a thickness of from about 50 micrometers to about 150 micrometers, and more specifically from about 75 micrometers to about 125 micrometers.

The conductive surface layer over or coated on the substrate support may vary in thickness from about 0.01 to about 1.0 micrometers depending on the optical transparency and flexibility desired for the electrophotographic imaging member. The conductive layer may be an electrically conductive metal layer which may be formed, for example, on the substrate by any suitable coating technique, such as, a vacuum depositing or sputtering technique. Typical metals include aluminum, zirconium, niobium, tantalum, vanadium, hafnium, titanium, nickel, stainless steel, chromium, tungsten, molybdenum, and the like.

Any suitable blocking layer capable of forming an electronic barrier to holes from the adjacent photoconductive or photogenerating layer and the underlying conductive layer may be utilized. The hole blocking layer may comprise nitrogen containing siloxanes or nitrogen containing titanium compounds as disclosed, for example, in U.S. Pat. Nos. 4,291,110, 4,338,387, 4,286,033 and 4,291,110, the disclosures of these patents being incorporated herein by reference in their entirety. The blocking layer may be applied by any suitable conventional technique, such as, spraying, draw bar coating, gravure coating, silk screening, air knife coating, reverse roll coating, vacuum deposition, chemical treatment, and the like. The blocking layer should be continuous and have a thickness of from about 0.01 to about 0.2 micrometers.

An optional adhesive layer may be applied to the hole blocking layer. Any suitable adhesive layer may be utilized. An adhesive layer comprising, for example, a linear saturated copolyester reaction product of four diacids and ethylene glycol may be utilized. This linear saturated copolyester consists of alternating monomer units of ethylene glycol and four randomly sequenced diacids in the above indicated ratio and has a weight average molecular weight of from about 70,000 copolyester resin. Any adhesive layer employed should be continuous and, for example, have a dry thickness of from about 200 micrometers to about 900 micrometers and, in embodiments from about 400 micrometers to about 700 micrometers. Any suitable solvent or solvent mixtures may be employed to form a coating solution of the polyester. Typical solvents include tetrahydrofuran, toluene, methylene chloride, cyclohexanone, and the like, and mixtures thereof. Any other suitable and conventional technique may be utilized to mix and thereafter apply the adhesive layer coating mixture to the hole blocking layer. Typical application techniques include spraying, roll coating, wire wound rod coating, and the like.

Any suitable charge generating layer may be applied to the adhesive layer, which can thereafter be overcoated with a contiguous charge transport layer. Examples of charge generating layer materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigment such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example in U.S. Pat. No. 4,587,189, the entire disclosure of which is incorporated herein by reference. Other suitable charge generating materials known in the art may also be utilized, if desired. Any suitable charge generating binder layer may be utilized. Photoconductive particles for the charge generating binder layer such vanadyl phthalocyanine, metal free phthalocyanine, benzimidazole perylene, amorphous selenium, trigonal selenium, selenium alloys, such as, selenium-tellurium, selenium-tellurium-arsenic, selenium arsenide, and the like and mixtures thereof may be used, for example, because of their sensitivity to white light. Vanadyl phthalocyanine, metal free phthalocyanine and tellurium alloys may also be utilized, for example, because these materials provide the additional benefit of being sensitive to infrared light. The photogenerating materials selected should be sensitive to activating radiation having a wavelength of from about 600 to about 700 nanometers.

Any suitable optional inactive resin material may be employed in the charge generating binder layer including those described, for example, in U.S. Pat. No. 3,121,006, the entire disclosure of which is incorporated herein by reference. Typical organic resinous binders include thermoplastic and thermosetting resins, such as, polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The charge generating composition or pigment can be present in the resinous binder composition in various amounts. Generally, from about 5 percent by volume to about 90 percent by volume of the charge generating pigment is dispersed in about 10 percent by volume to about 95 percent by volume of the resinous binder, and in embodiments from about 20 percent by volume to about 30 percent by volume of the charge generating pigment is dispersed in about 70 percent by volume to about 80 percent by volume of the resinous binder composition.

The charge generating layer ranges in thickness for example, of from about 0.1 micrometers to about 5 micrometers, and in embodiments has a thickness of from about 0.3 micrometers to about 3 micrometers. The charge generating layer thickness is related to binder content. Higher binder content compositions generally utilize thicker layers for charge generation. Thicknesses outside these ranges may also be selected.

The charge, or hole transport layer may comprise any suitable transparent organic polymer or non-polymeric material capable of supporting the injection of photo generated holes from the charge generating layer below and allowing the transport of these holes through the organic layer to selectively discharge the surface charge. The active hole transport layer not only serves to transport holes, but also protects the photogenerating layer from abrasion or chemical attack and therefor extends the operating life of the photoreceptor imaging member. The charge transport layer should exhibit negligible, if any, discharge when exposed to a wavelength of light of from about 4,000 angstroms to about 9,000 angstroms. Therefore, the charge transport layer is substantially transparent to radiation in a region in which the photoconductor is to be used. Thus, the active hole transport layer is a substantially non-photoconductive material but supports the injection of photogenerated holes from the generation layer. The active hole transport layer is normally transparent when exposure is effected through the active layer to ensure that most of the incident radiation is utilized by the underlying charge carrier generator layer for efficient photogeneration. The hole transport layer in conjunction with the generation layer in the instant invention is a material which is an insulator to the extent that an electrostatic charge placed on the hole transport layer is not conducted in the absence of illumination.

The active hole transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough.

Any suitable arylamine hole transporter molecules may be utilized in the hole transport layer. In embodiments, the hole transport layer comprises, for example, from about 35 percent to about 65 percent by weight of at least one hole transporting aromatic amine compound and about 65 percent to about 35 percent by weight of a polymeric film forming resin in which the aromatic amine is soluble to form a solid solution hole transport layer. Typical aromatic amine hole transporting compounds include, for example, triphenylmethane, bis(4-diethylamine-2-methylphenyl) phenylmethane; 4'-4"-bis(diethylamino)-2',2"-dimethyltriphenylmethane, N,N'-diphenyl-N,N'-bis (alkylphenyl)-[1,1'-biphenyl]-4,4~-diamine wherein the alkyl is, for example, methyl, ethyl, propyl, n-butyl, hexyl, etc., N,N'-diphenyl-N,N'-bis(chlorophenyl)-[1,1'-biphenyl]-4,4'-diamine, and the like, dispersed in an inactive film forming binder.

Examples of inactive resin binders include polycarbonate resin, polyvinylcarbazole, polyester, polyarylate, polyacrylate, polyether, polysulfone, and the like. Molecular weight average of a polymer binder can vary, for example, from about 20,000 to about 1,500,000.

Any suitable and conventional technique may be utilized to mix and thereafter apply the hole transport layer coating mixture onto the charge generating layer. Typical application techniques include spraying, extrusion die coating, roll coating, wire wound rod coating, and the like. Drying of the deposited coating may be effected by any suitable conventional technique such as oven drying, infra red radiation drying, air drying and the like. Generally, the thickness of the transport layer is from about 5 micrometers and about 100 micrometers.

In embodiments, the ratio of the thickness of the charge transport layer to the charge generator layer is, for example, from about 2.1 to 400:1, and more specifically from about 2:1 to about 200:1.

An anti-curl back coating may be applied to the back side of the substrate support (which is the side opposite the side bearing the electrically active coating layers) to balance the curl and render flatness. The anti-curl back coating may comprise any suitable organic or inorganic film forming polymers that are electrically insulating or slightly semiconductive. In some cases, an anti-curl back coating may be applied to the surface of the substrate opposite to that bearing the photoconductive layer to provide flatness and/or abrasion resistance where a web configuration photoreceptor is fabricated. Overcoatings are continuous and typically have a thickness of less than about 10 microns, although the thickness can be outside this range. The thickness of anti-curl backing layers generally is sufficient to balance substantially the total forces of the layer or layers on the opposite side of the substrate layer. An example of an anti-curl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat may have a thickness of at most 3 microns for insulating matrices and at most 6 microns for semi-conductive matrices. The use of such an overcoat can still further increase the wear life of the photoreceptor, the overcoat having a wear rate of 2 to 4 microns per 100 kilocycles, or wear lives of from about 150 to about 300 kilocycles.

The electron transporter selected for use either in the positively charged or in the ambipolar single photoconductive insulating layer of the imaging member can be selected from for example, the group consisting of a carboxlfluorenone malonitrile (CFM) represented by:

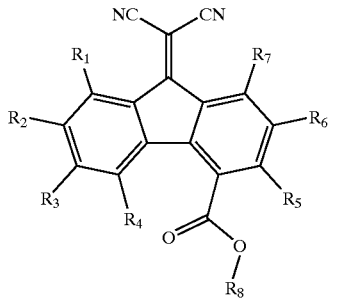

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic, for example, naphthalene and antracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, a nitrated fluoreneone derivative represented by:

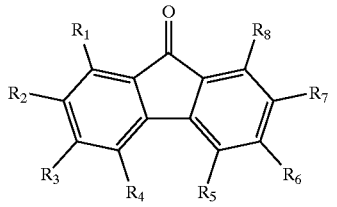

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic, for example, naphthalene and antracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, and at least two R groups are chosen to be nitro groups, N,N'bis(dialkyl)-1,4,5,8-naphthalenetetracarboxylic diimide derivative, or N,N'bis(diaryl)-1,4,5,8-naphthalenetetracarboxylic diimide derivative represented by:

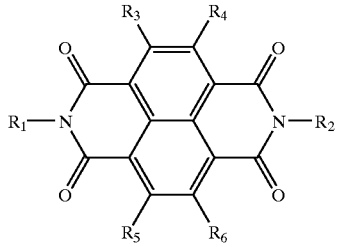

wherein $R_1$ is substituted or unsubstituted alkyl, branched alkyl, cycloalkyl, alkoxy or aryl, for example, phenyl, naphthyl, or a higher polycyclic aromatic, for example, anthracene $R_2$ is alkyl, branched alkyl, cycloalkyl, or aryl, for example, phenyl, naphthyl, or a higher polycyclic aromatic, for example, anthracene or the same as $R_1$; $R_1$ and $R_2$ can be chosen independently to have total carbon number from about 1 to about 50 and in embodiments from about 1 to about 12. $R_3$, $R_4$, $R_5$ and $R_6$ are alkyl, branched alkyl, cycloalkyl, alkoxy or aryl, for example, phenyl, naphthyl, or a higher polycyclic aromatic such as anthracene or halogen and the like. $R_3$, $R_4$, $R_5$ and $R_6$ can be the same or different. In the case where $R_3$, $R_4$, $R_5$ and $R_6$ are carbon, they can be chosen independently to have a total carbon number from about 1 to about 50, but is in embodiments from about 1 and to about 12, 1,1'-dioxo-2-(aryl)-6phenyl-4-(dicyanomethylidene)thiopyran derivative represented by:

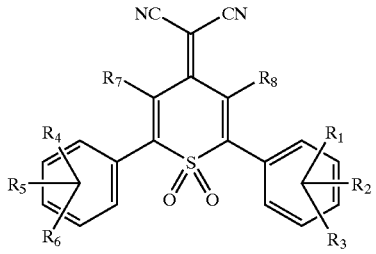

wherein each R is independently selected from the group consisting of hydrogen, alkyl containing from about 1 to about 40 carbon atoms, alkoxy containing from about 1 to about 40 carbon atoms, phenyl, substituted phenyl, or higher aromatic, for example, naphthalene and antracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, a carboxybenzylnaphthaquinone derivative represented by:

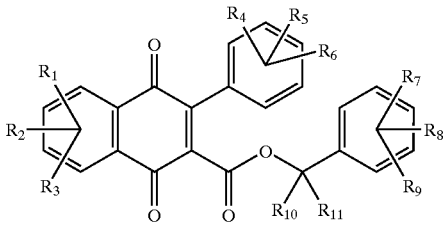

and/or

-continued

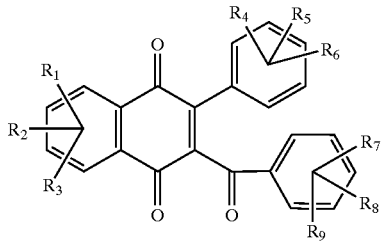

wherein each R is independently selected from the group consisting of hydrogen, alkyl containing from about 1 to about 40 carbon atoms, alkoxy containing from about 1 to about 40 carbon atoms, phenyl, substituted phenyl, higher aromatic, for example, naphthalene and antracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, and a diphenoquinone represented by:

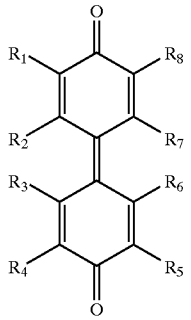

and mixtures thereof, wherein each R is independently selected from the group consisting of hydrogen, alkyl containing from about 1 to about 40 carbon atoms, alkoxy containing from about 1 to about 40 carbon atoms, phenyl, substituted phenyl, higher aromatic, for example, naphthalene and antracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen, and a film forming binder.

The electron transporting materials contribute to the ambipolar properties of the photoreceptor and can provide the desired rheology. Moreover, these electron transporting materials ensure substantial discharge of the photoreceptor during image wise exposure to form the electrostatic latent image.

The above materials can be processed into a dispersion useful for coating by any of the conventional methods used to prepare such materials. These methods include; ball milling, media milling (in both vertical or horizontal bead mills), paint shaking the materials with suitable grinding media, and the like to achieve a suitable dispersion. The photoconductive insulating layer may be prepared by any suitable method such as, for example, from a dispersion.

The photogenerating pigment particles, electron transport molecules, and charge transport molecules coating mixture can be coated by any suitable technique, for example, by using a spray coater, extrusion coater, roller coater, wire-bar coater, slot coater, doctor blade coater, gravure coater, and the like. Any suitable solvent may be utilized for coating. Typical solvents include, for example, ketones, alcohols, aromatic hydrocarbons, halogenated aliphatic hydrocarbons, ethers, amines, amides, esters, and the like. Specific examples of solvents include cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like. Since the crack resistant imaging members of the present invention can be prepared by a number of known coating methods, the coating process parameters are dependent on the specific process, materials, coating component proportions, the final coating thickness desired, and the like. Drying may be carried out by any suitable technique. Typically, drying is carried out at a temperature of from about 40 degrees centigrade to about 200 degrees centigrade for a suitable period. Typical drying times include, for example, from about 5 minutes to about 10 hours under still or flowing air conditions.

The thickness of the single layer after drying can typically be, for example, from about 3 micrometers to about 50 micrometers and in embodiments, from about 5 micrometers to about 40 micrometers. The maximum thickness of the photoconductive insulating layer in any given embodiment is dependent primarily upon factors such as photosensitivity, electrical properties and mechanical considerations.

The imaging member may by employed in any suitable process such as, for example, copying, duplicating, printing, faxing, and the like. Typically, an imaging process may comprise forming a uniform charge on the imaging member of the present invention, exposing the imaging member to activating radiation in image configuration to form an electrostatic latent image, developing the latent image with electrostatically attractable marking material to form a marking material image, and transferring the marking material image to a suitable substrate. If desired, the transferred marking material image may be fixed to the substrate or transferred to a second substrate. Electrostatically attractable marking materials are known and comprise, for example, a thermoplastic resin, a colorant, such as a pigment, a charge additive, and surface additives. Typical marking materials are disclosed in U.S. Pat. Nos. 4,560,635; 4,298,697 and 4,338,390, the entire disclosures thereof being incorporated herein by reference. Activating radiation may be from any suitable device such as an incandescent light, image bar, laser, and the like. The polarity of the electrostatic latent image on the imaging member of the present invention may be positive or negative.

The invention will further be illustrated in the following non-limiting working examples, it being understood that these examples are intended to be illustrative only and that the invention is not intended to be limited to the materials, conditions, process parameters and the like recited herein.

COMPARATIVE EXAMPLE

An electrophotographic imaging member web stock was prepared by providing a 0.02 micrometers thick titanium layer coated on a biaxially oriented polyethylene naphthalate substrate (KALADEX™, available from Dupont, Inc.) having a thickness of 3.5 micrometers (89 micrometers) and applying thereto, using a gravure coating technique a solution containing 10 grams gamma aminopropyltriethoxy silane, 10.1 grams distilled water, 3 grams acetic acid, 684.8 grams of 200 proof denatured alcohol and 200 grams heptane. This layer was then allowed to dry for 5 minutes at 135 degrees Celsius in a forced air oven. The resulting hole blocking layer of nitrogren containing siloxanes had an average dry thickness of 0.05 micrometers as measured with an ellipsometer.

An adhesive interface layer was then prepared by extrusion application to the hole blocking layer of nitrogen containing siloxanes, a wet coating containing 5 percent by weight based on the total weight of the solution of a polyester adhesive (MOR-ESTER 49,000™, available from Morton International, Inc.) in a 70:30 volume ratio mixture of tetrahydrofuranlcyclohexanone. The adhesive interface layer was allowed to dry for 5 minutes at 135 degrees Celsius in the forced air oven. The resulting adhesive interface layer of MORESTER in tetrahydrofuranl cyclohexane had a dry thickness of 0.065 micrometers.

The adhesive interface layer was thereafter coated with a photogenerating layer. The photogenerating layer dispersion was prepared by introducing 0.45 grams of IUPILON 200™ poly(4,4'-diphenyl)-1,1'-cyclohexane carbonate, available from Mitsubishi Gas Chemical Corp., and 50 milliliters of tetrahydrofuran into a 4 ounce glass bottle. To this solution was added 2.4 grams of hydroxygallium phthalocyanine and 300 grams of ⅛ inch (3.2 millimeters) diameter stainless steel shot. This mixture was then placed on a ball mill for 20 to 24 hours. Subsequently, 2.25 grams of poly(4,4'-diphenyl)-1,1'-cyclohexane carbonate was dissolved in 46.1 grams of tetrahydrofuran, then added to this hydrogallium phthalocyanine slurry. This slurry was then placed on a shaker for 10 minutes. The resulting slurry was, thereafter, coated onto the adhesive interface by extrusion application process to form a layer having a wet thickness of 0.25 milliliters. However, a strip about 10 millimeters wide along one edge of the substrate web bearing the blocking layer and the adhesive layer was deliberately left uncoated by any of the photogenerating layer material to facilitate adequate electrical contact by the ground strip layer that was applied later. This photogenerating layer was dried at 135 degrees Celsius for 5 minutes in a forced air oven to form a dry thickness photogenerating layer having a thickness of 0.4 micrometer layer.

This coated imaging member was simultaneously overcoated with a hole transport layer and a ground strip layer using extrusion co-coating process. The hole transport layer was prepared by introducing into an amber glass bottle a weight ratio of 1:1 organic hole transport molecule N,N'-diphenyl-N,N'-bis(3-methylphenyl)-1,1'-biphenyl-4-4'-diamine and poly(4,4'-isopropylidene diphenyl carbonate), having a weight average molecular weight of about 120,000, commercially available as MAKROLON 5705™, from Bayer A.G. The resulting mixture was dissolved to give a 15 percent by weight solid in 85 percent by weight methylene chloride. This solution was applied onto the photogenerator layer to form a coating which upon drying gave a hole transport layer diamine thickness of 29 micrometers.

The approximately 10 millimeter wide strip of the adhesive layer left uncoated by the photogenerator layer was coated over with a ground strip layer of aluminum during the co-coating process. This ground strip layer, after drying along with the co-coated hole transport layer at 135 degrees Celsius in the forced air oven for about 5 minutes, had a dried thickness of about 19 micrometers. This ground strip is electrically grounded by conventional means, such as, a carbon brush contact during conventional xerographic imaging process. The imaging member, if unrestrained, at this point, did exhibit spontaneous upward curling into a 1½ inch roll.

An anti-curl coating was prepared by combining 8.82 grams of polycarbonate resin (MAKROLON 5705™, available from Bayer AG), 0.72 gram of polyester resin (VITEL PE-200™, available from Goodyear Tire and Rubber Company) and 90.1 grams of methylene chloride in a glass container to form a coating solution containing 8.9 percent solids. The container was covered tightly and placed on a roll mill for about 24 hours until the polycarbonate and polyester were dissolved in the methylene chloride to form the anti-curl coating solution. The anti-curl coating solution was then applied to the rear surface (side opposite the photogenerator layer and hole transport layer) of the imaging member web stock, again by extrusion coating process, and dried at 135 degrees Celsius for about 5 minutes in the forced air oven to produce a dried film thickness of about 17 micrometers and render flatness. The resulting electrophotographic imaging member for negative charging system was used to serve as an imaging member control.

EXAMPLE I

Two hole transport layer solutions were prepared according to the procedures described in the Comparative Example, but with the exception that the MAKROLON™ in one of these coating solutions was by a processing to effect the removal or elimination of the low molecular weight fraction from the polymer prior to coating solution preparation, wherein low represents a weight average molecular weight of from about 1,000 to about 20,000 and a number average molecular weight of from about 1,000 to about 20,000. These coating solutions were each coated over a releasing surface of a thick polyvinyl fluoride substrate and dried at 135 degrees Celsius to remove the layer of methylene chloride yielding two, 30 micrometer thick hole transport layers. The process adopted for removal of low molecular weight fraction was carried out by first dissolving the MAKROLON™, as received from Bayer, in methylene chloride to form a solution followed by gradual addition of methanol (a non solvent) to the solution to effect the precipitation of the high molecular weight component of the polymer from the solution, wherein high represents a weight average molecular weight of from about 20,000 to about 120,000 and a number average molecular weight of from about 20,000 to about 120,000. The precipitates were then filtered and dried to provide the MAKROLON™.

Mechanical properties of these two layers showed that the elimination of the low molecular weight fraction from MAKROLON™ could effectively increase the break elongation and the break stress of the transport layer.

EXAMPLE II

An electrophotographic imaging member was prepared according to the procedures and using the same material as that described in Comparative Example, with the exception that the hole transport layer as well as the anti-curl back coating were prepared with the precipitated MAKROLON™ of Example I. The prepared imaging member and the imaging member of Comparative Example were cut to give 1 inch×6 inch samples, each were subjected to low speed sample tensile elongation, using an Instron Mechanical Tester. The exact extent of stretching at which onset of hole transport layer cracking became evident was analyzed under 100× magnification with a stereo optical microscope. The hole transport layer cracking strains observed was about 3.25 percent for the Comparative Example and about 4 percent for the corresponding imaging member using precipitated MAKROLON™ in the hole transport layer.

Since removal of low molecular weight fraction did not alter the chemical make-up of the polymer, but merely improved its mechanical strength and crack resistance, no deleterious photo-electrical impact was evident.

Dynamic Mechanical Testing Results

The electrophotographic imaging member web stocks of the Comparative Example and Example II were each cut to give rectangular sheets having precise dimensions of 440 millimeters width and 2,808 millimeters in length. Each cut imaging member sheet was ultrasonically welded to form a seamed flexible imaging member belt for dynamic fatigue electrophotographic imaging and print testing in a xerographic machine, employing a belt cycling module utilizing four 49 millimeter diameter, three 32.7 millimeter diameter, and one small 24.5 millimeter diameter belt support rollers. The belt cycling test results obtained showed that the onset of fatigue in the hole transport layer was significantly extended by a factor of about 2½ times for the belt prepared from the imaging member of Example II compared to that of the belt prepared from the imaging member of the Comparative Example. The delay of transport layer cracking was further established for the member of Example I by static bend-parking over a 19 millimeter diameter roller using a methylene chloride vapor exposure test.

The electrophotographic imaging members of the Comparative Example and Example II were cut to a size of 1 inch (2.54 centimeters) by 12 inches (30.48 centimeters) and tested for resistance to wear using a dynamic mechanical cycling device in which glass tubes were skidded across the surface of the hole transport layer on each imaging member.

The extent of the hole transport layer wear was measured using a permascope at the end of a 330,000 wear cycle tests. The wear resistance of the anti-curl back coating was also tested as described by positioning each test sample such that the anti-curl back coating was facing the sliding glass surface to effect wear contact.

The wear resistance testing results obtained for the hole transport layer and the anti-curl back coating were consistently enhanced by about 40 percent using precipitated MAKROLON™, for example, a control hole transport layer thickness was 30 micrometers before testing and 19 micrometers after 330,000 wear cycles test. Using the precipitated MAKROLON, the hole transport layer thickness was 30 micrometers before and 23.4 micrometers after 330,000 wear cycles.

The control anti-curl backing coating thickness was 17 micrometers before and 7.5 micrometers after 330,000 wear cycles test. Using the precipitated MAKROLON, the anti-curl back coating thickness was 17 micrometers before testing and 11.1 micrometers after 330,000 wear cycles.

Although the invention has been described with reference to specific embodiments, it is not intended to be limited thereto. Rather, those having ordinary skill in the art will recognize that variations and modifications, including equivalents, substantial equivalents, similar equivalents, and the like may be made therein which are within the spirit of the invention and within the scope of the claims.

What is claimed is:

1. A member comprising:

a substrate;

a charge blocking layer;

an optional adhesive layer;

a charge generating layer;

a charge transport layer comprising a charge transport component and a binder; and an anti-curl back coating, said binder comprising a polymer that is substantially free of low molecular weight fractions, wherein low molecular weight represents a weight average molecular weight of from about 1,000 to about 20,000 and a number average molecular weight of from about 1,000 to about 20,000.

2. A member according to claim 1, wherein the charge transport layer binder comprises a polymer comprising high molecular weight fractions, wherein high molecular weight represents a weight average molecular weight of from about 20,000 to about 120,000 and a number average molecular weight of from about 20,000 to about 120,000, and wherein the binder is present in an amount of from about 45 to about 55 weight percent based on the total weight of the charge transport layer.

3. A member according to claim 1, wherein the binder is selected from the group consisting of polycarbonate, polyvinylcarbazole, polyester, polyarylate, polyacrylate, polyether, and polysulfone.

4. A member according to claim 1, wherein the charge transport layer contains the binder in an amount of from about 30 to about 90 weight percent based on the total weight of the charge transport layer.

5. A member according to claim 1, wherein the charge transport layer binder comprises a polymer containing high molecular weight fractions, wherein high molecular weight represents a weight average molecular weight of from about 20,000 to about 120,000 and a number average molecular weight of from about 20,000 to about 120,000, and wherein the binder is present in an amount of from about 45 to about 55 weight percent based on the total weight of the charge transport layer.

6. A member according to claim 1, wherein the charge transport layer comprises a binder selected from the group consisting of bisphenol A polycarbonate, poly(4,4'-isopropylidene diphenyl) carbonate, and poly(4,4'-diphenyl)-1,1'-cyclohexane carbonate.

7. A member according to claim 1, wherein the binder contains a polymer with a molecular weight distribution of from about 50,000 to about 120,000.

8. A member according to claim 1, wherein the binder used in the charge transport layer comprises poly(4,4'-diphenyl)-1,1'-cyclohexane carbonate.

9. A member according to claim 1, wherein the charge transport layer further comprises an electron transport component selected from the group consisting of carboxlfluorenone represented by:

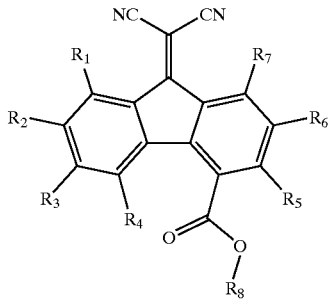

wherein each R is independently selected from the group consisting of hydrogen, alkyl, alkoxy, aryl and halogen, a nitrated fluoreneone represented by:

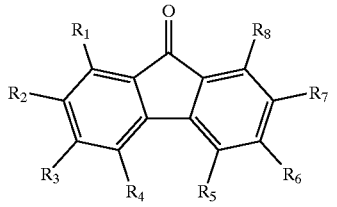

wherein each R is independently selected from the group consisting of hydrogen, alkyl, alkoxy, aryl and halogen, and wherein at least two R groups are nitro, N,N'bis(dialkyl)- 1,4,5,8-naphthalenetetracarboxylic diimide, or a N,N'bis(diaryl)-1,4,5,8-naphthalenetetracarboxylic diimide represented by:

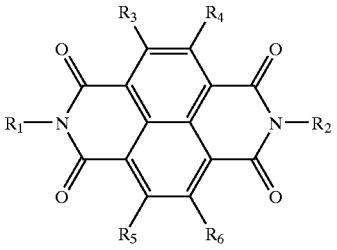

wherein $R_1$ is alkyl, alkoxy or aryl, $R_2$ is alkyl, or aryl; $R_1$, $R_2$, $R_3$, $R_4$, $R_5$ and $R_6$ are select from the group consisting of alkyl, alkoxy, and halogen.

10. A member according to claim 1, wherein the charge transport layer contains an electron transport layer comprising:

1,1'-dioxo-2-(aryl)-6-phenyl-4-(dicyanomethylidene) thiopyran represented by:

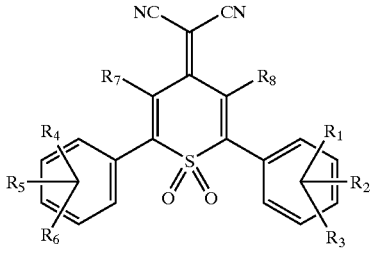

wherein each R is independently selected from the group consisting of hydrogen, alkyl containing from about 1 to about 40 carbon atoms, alkoxy containing from about 1 to about 40 carbon atoms, phenyl, substituted phenyl, naphthalene and antracene, alkylphenyl containing from about 6 to about 40 carbons, alkoxyphenyl containing from about 6 to about 40 carbons, aryl containing from about 6 to about 30 carbons, substituted aryl containing from about 6 to about 30 carbons and halogen.

11. A member according to claim 1, wherein the charge transport layer contains an electron transport component comprising:

a carboxybenzylnaphthaquinone derivative represented by:

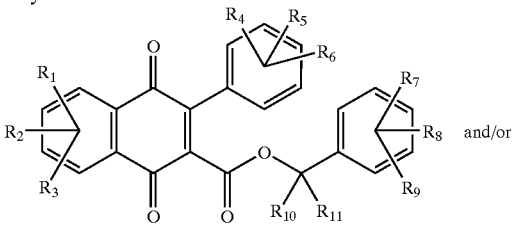

and/or

-continued

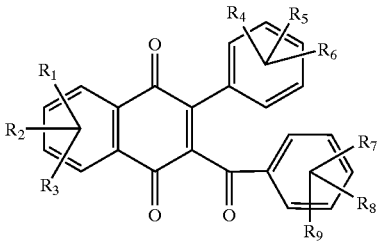

wherein each R is independently selected from the group consisting of hydrogen, alkyl, alkoxy, aryl and halogen;

a diphenoquinone represented by:

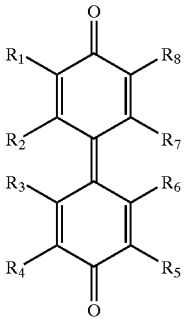

wherein each R is independently selected from the group consisting of hydrogen, alkyl, alkoxy, aryl and halogen, and mixtures thereof.

12. A member according to claim 1, wherein the charge transport layer comprises a hole transport component comprising an aryl amine represented by:

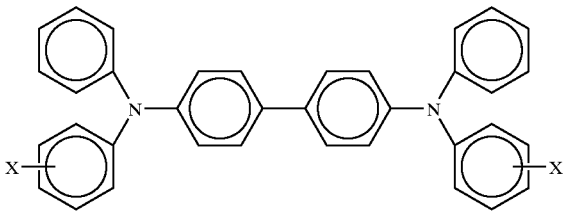

wherein X is selected from the group consisting of alkyl and halogen.

13. A member according to claim 12, wherein the arylamine is N,N'-diphenyl-N,N'-bis(3-methylphenyl)-[1,1'-biphenyl]-4,4'-diamine.

14. A member according to claim 12, wherein the arylamine is N,N'-diphenyl-N,N'-bis(4-methylphenyl)-[1,1'-biphenyl]-4,4'-diamine.

15. A member according to claim 1, wherein the charge transport layer comprises a charge transport component in an amount of from about 10 to about 70 weight percent based on the total weight of the charge transport layer.

16. A member according to claim 9 wherein the charge transport layer has a weight ratio of the charge transport molecule to the binder of from about 10:90 to about 70:30.

17. A member according to claim 1, wherein the charge transport layer comprises poly(4,4'-diphenyl)- 1,1'-cyclohexane and N,N'-diphenyl-N,N'-bis(3-methylphenyl)-[1,1'-biphenyl]-4,4'-diamine in a weight ratio of the binder to charge transport component of from about 90:10 to about 30:70.

18. A member according to claim 12, wherein the hole transport component is selected from the group consisting of N,N'-diphenyl-N,N'-bis(3-methylphenyl)-[1,1'-biphenyl]-4,4'-diamine; N,N'-diphenyl-N,N'-bis(4-methylphenyl)-[1,1'-biphenyl]-4,4'-diamine; N,N'-diphenyl-N,N'-bis(alkylphenyl)-1,1'-biphenyl-4,4'-diamine; Tritolylamine; N,N'-bis-(3,4-dimethylphenyl)-4-biphenyl amine; N,N'-bis(4-methylphenyl)-N,N'-bis(4-ethylphenyl)-1,1'-3,3'-dimethylbiphenyl)-4,4'-diamine; phenanthrene diamine, and stilbene molecules.

19. A member according to claim 1, wherein the charge generating layer has a thickness of from about 0.1 micrometer to about 5 micrometers.

20. A member according to claim 1, wherein the charge generating layer comprises from about 10 percent to about 95 percent by volume of the binder, based on the total volume of the charge generating layer.

21. A member according to claim 1, wherein the charge generating layer comprises from about 80 percent to about 70 percent by volume of the binder, based on the total volume of the charge generating layer.

22. A member comprising:

an ambipolar layer comprising a hole transport component, an electron transport component, a photogenerating component and a film forming resin binder, wherein the binder comprises a polymer substantially free of low molecular weight fractions, and wherein low molecular weight represents a weight average molecular weight of from about 1,000 to about 20,000 and a number average molecular weight of from about 1,000 to about 20,000; and an anti-curl back coating.

23. A member according to claim 22, wherein the ambipolar layer comprises from about 5 percent to about 50 percent by weight of an arylamine hole transport component, about 1 percent to about 40 percent by weight of an electron transport component, about 0.05 percent to about 30 percent by weight of photogenerating pigment.

24. A member according to claim 22, wherein the ambipolar layer comprises from about 20 percent to about 40 percent by weight of the arylamine hole transport component, about 5 percent to about 30 percent by weight electron transport component, and wherein the ambipolar layer further comprises a polymer binder free of polymer fractions having a molecular from about 5,000 to about 20,000, and wherein the ambipolar layer comprises high molecular weight fractions of polycarbonate, wherein high molecular weight represents a weight average molecular weight of from about 20,000 to about 120,000 and a number average molecular weight of from about 20,000 to about 120,000.

25. An imaging process comprising:

providing a member comprising;

a support layer, a photogenerator layer, and a charge transport layer, said charge transport layer comprising a charge transport component and a binder comprising a polymer substantially free of low molecular weight fractions, and forming an image using said member, wherein low molecular weight represents a weight average molecular weight of from about 1,000 to about 20,000 and a number average molecular weight of from about 1,000 to about 20,000.

26. A member according to claim 1 and containing an adhesive layer comprising a linear saturated co-polyester reaction product of diacids and ethylene glycol and having a thickness of from about 200 micrometers to about 900 micrometers.

27. A member according to claim 26 wherein the adhesive layer has a thickness of from about 400 micrometers to about 700 micrometers.

28. A member according to claim 1 wherein the substrate comprises a biaxially oriented polyethylene naphthalate substrate and wherein the thickness is from about 50 to about 150 micrometers.

29. A member according to claim 1 wherein the anti-curl polymer is selected from the group consisting of polyester, polyarylate, polysulfone, polyethersulfone, polyetherimide, polycarbonate, and polystyrene-acrylonitrile and has a thickness of from about 50 to about 200 microns.

30. A member according to claim 1 wherein the blocking layer comprises nitrogen containing siloxanes.

31. A member according to claim 1 wherein the blocking layer comprises nitrogen containing titanium.

* * * * *